US005674079A

United States Patent [19]

Auclair

[11] Patent Number: 5,674,079

[45] Date of Patent: Oct. 7, 1997

[54] GROUND LUG

[75] Inventor: William T. Auclair, Winsted, Conn.

[73] Assignee: Electric Motion Company, Inc., Winsted, Conn.

[21] Appl. No.: 455,160

[22] Filed: May 31, 1995

[51] Int. Cl.[6] ..... H01K 4/66

[52] U.S. Cl. ..... 439/92; 439/812

[58] Field of Search ..... 439/92, 811, 812

[56] References Cited

U.S. PATENT DOCUMENTS 2,532,068 11/1950 Larsen ..... 439/811

2,976,515 3/1961 Charbonneau et al. ..... 439/811

*Primary Examiner*—Gary F. Paumen

*Assistant Examiner*—Christopher Goins

*Attorney, Agent, or Firm*—Chilton, Alix & Van Kirk

[57] ABSTRACT

A ground lug comprising a collar which defines a receptacle for receiving a ground wire. A machine screw is threadably positionable in an aperture in the collar upper surface to engage a clamping plate and clamp a ground wire positioned between the collar and the clamping plate lower surface. The clamping plate has first, second, and third segments. The first segment has an aperture for bolting the ground lug to a ground point. The second segment has an axially extending tang and defines a first transverse shoulder. The third segment has a first end portion having axially extending tabs defining a second transverse shoulder. The third segment is inserted in the collar receptacle wherein the first shoulder engages the collar first end and the collar first end is received between the third segment and the tang. Rotating the clamping plate causes the second shoulder to engage the collar second end. The clamping plate may be further secured in place by crimping the tab towards the collar.

13 Claims, 2 Drawing Sheets

GROUND LUG

BACKGROUND OF THE INVENTION

This invention relates generally to devices for implementing a ground connection between a ground wire and a common ground point. More particularly, the present invention relates to clamp devices which mount to ground wires and which may be bolted to a common ground point.

A number of various types of devices have been employed for connecting a ground wire to a common ground point. A number of conventional devices employ a collar for receiving a ground wire. A machine screw engages a clamping plate disposed in the collar to clamp the ground wire in the collar. In one of such devices, indentations on the collar inner surface are employed to prevent turning of the clamping plate within the collar. Although the clamping plate is prevented from fully turning, the indentations do not prevent all rotational movement within the collar. Therefore, this type of device is subject to disassembly due to vibration. In another such device, the clamping plate is staked to the screw with an integral rivet. Although this type of device is resistant to disassembly, it is relatively expensive to manufacture.

SUMMARY OF THE INVENTION

A ground lug in accordance with the present invention comprises a collar having an upper U-shaped first portion and a lower V-shaped second portion defining a receptacle for receiving a ground wire. A machine screw threaded to the collar engages a clamping plate to clamp the ground wire in the collar. The clamping plate has first, second, and third segments. The first segment has an aperture for bolting the ground lug to a ground point. The second segment has an axially and radially extending tang and defines a first shoulder. The third segment has a first end portion defining axially extending tabs defining a second shoulder. The third segment is inserted in the collar receptacle wherein the first shoulder engages the collar first end, the second shoulder engages the collar second end, and the collar first end is received between the third segment and the tang. A ground wire is inserted in the collar receptacle between the collar lower portion and the clamping plate lower surface. Applying torque to the machine screw causes the distal end of the machine screw to engage the upper surface of the clamping plate. Applying continued torque causes the clamping plate to engage the ground wire, clamping the ground wire in the ground lug.

The clamping plate may be cut from a sheet or coil of material and shaped in a single stamping operation and is therefore inexpensive to manufacture. The tang and the first and second shoulders provide sufficient engagement with the collar to prevent rotation of the clamping plate within the collar. Therefore, a ground lug in accordance with the present invention is not subject to disassembly due to vibration or handling induced rotation. Further, a ground lug in accordance with the present invention does not require staking with a rivet to prevent such rotation.

An object of the present invention is to provide a new and improved ground lug.

Another object of the present invention is to provide a new and improved ground lug which is resistant to disassembly due to vibration or handling.

A further object of the present invention is to provide a new and improved ground lug having a clamp plate that resists rotation and is inexpensive to manufacture.

Other objects and advantages of the invention will become apparent from the drawings and the specification.

BRIEF DESCRIPTION OF THE DRAWING

The present invention may be better understood and its numerous objects and advantages will become apparent to those skilled in the art by reference to the accompanying drawing in which.

DETAILED DESCRIPTION OF THE PREFERRED EMBODIMENT

Figure 1:
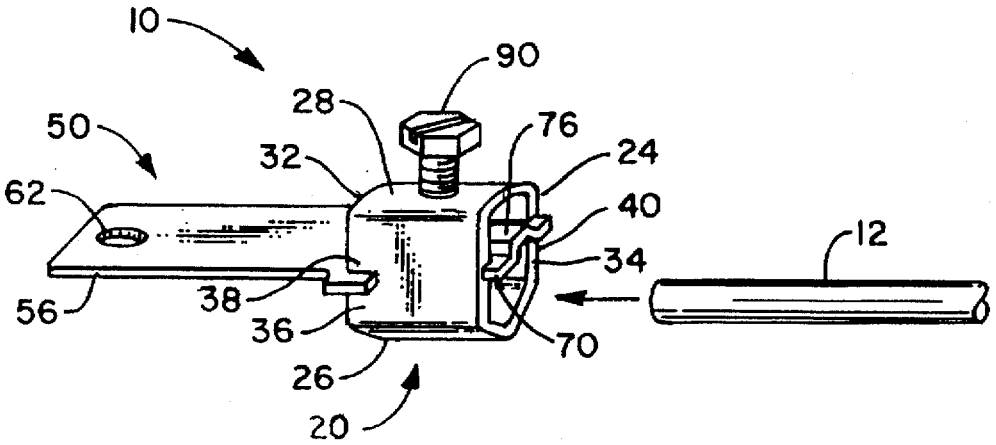
FIG. 1 is a perspective view of a ground lug in accordance with the present invention, illustrated in conjunction with a ground wire.

With reference to the drawings wherein like numerals represent like parts throughout the several figures, an improved ground lug in accordance with the present invention is generally designated by the numeral 10. The ground lug 10 comprises a collar 20 for receiving and clamping a ground wire 12.

The collar 20 comprises an upper U-shaped first portion 24 and a lower V-shaped second portion 26 defining a receptacle 22. A machine screw 90 is engaged to a threaded aperture 30 in the upper surface 28 of the first portion 24 wherein the distal end of the machine screw 90 is threadably positionable in the receptacle 22. The distal end of the machine screw 90 engages a clamping plate 50 to clamp the ground wire 12 in the collar 20. In a preferred embodiment, the collar 20 is composed of electrically conductive material.

Figure 2:
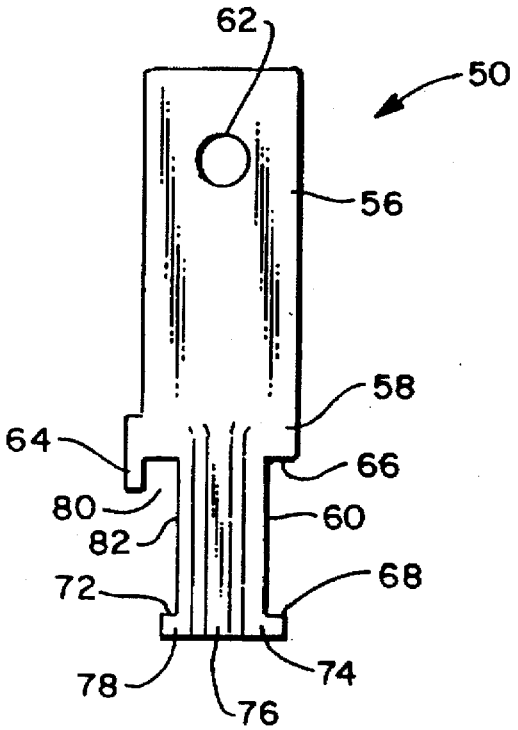
FIG. 2 is an enlarged top plan view of the clamping plate of the ground lug of FIG. 1.
Figure 3:
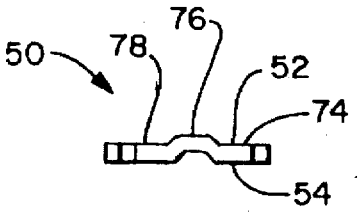
FIG. 3 is a front view of the clamping plate of FIG. 2.
Figure 4:
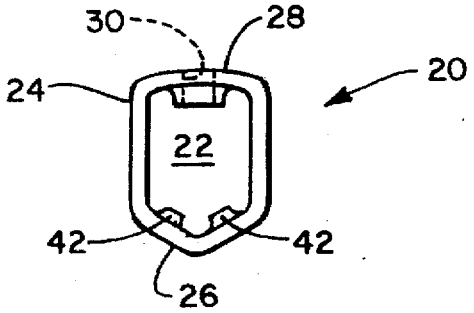
FIG. 4 is an enlarged front view of the collar of the ground lug of FIG. 1.
Figure 5:
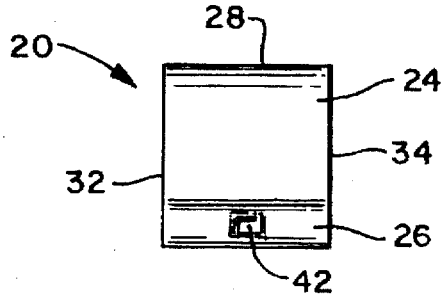
FIG. 5 is a side view of the collar of FIG. 4.

The clamping plate 50 is comprised of a plate-like member, composed of electrically conductive material, having opposite first and second surfaces 52, 54. The plate 50 has first, second, and third segments 56, 58, 60. The first segment 56 has an aperture 62 for bolting the ground lug to a ground point (not shown). The second segment 58 has an axially extending tang 64 and defines a first transverse shoulder 66. As shown in FIG. 2, the tang 64 may also extend radially. An end portion 68 of the third segment 60 has a pair of axially extending tabs 70 defining a second transverse shoulder 72.

In a preferred embodiment, the third segment 60 comprises respective first, second and third laterally extending portions 74, 76, 78. The center portion 76 extends outwardly from the first and third portions 74, 78 to structurally reinforce the third segment 60. The center portion 76 defines a plane which is displaced from the plane defined by the first and third portions 76, 78. The distal end of the machine screw 90 engages the third segment center portion 76.

Figure 6:
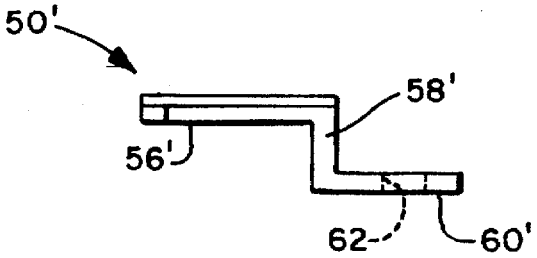
FIG. 6 is a side view of an alternate embodiment of the clamping plate of FIG. 2.

In an embodiment shown in FIG. 6, the clamping plate 50' is bent such that the plane defined by the second segment 58' is orthogonal to the planes defined by the first and third segments 56', 60'.

The clamping plate third segment 60 is inserted diagonally into the collar receptacle 22 at one end 32 of the collar 20 until the first shoulder 66 abuts a first sidewall 36 of the collar 20. A portion 38 of the sidewall 36 is received in the gap 80 between the tang 64 and the side 82 of the third segment 60. The third segment tabs 70 extend beyond the opposite end 34 of the collar 20 when the third segment 60 has been fully inserted. Rotating the clamping plate 50 engages the second shoulder 72 against the second sidewall 40 of the collar 20, locking the clamping plate 50 in the collar 20. The tang 64 may be crimped towards the third segment side 82 to further lock the clamping plate 50 in the collar 20.

A ground wire 12 is inserted in the collar receptacle 22 in the collar second portion 26 between the collar 20 and the clamping plate second surface 54. The machine screw 90 is torqued so that it engages the first surface 52 of the clamping plate 50. Applying continued torque causes the clamping plate 50 to engage the ground wire 12, clamping the ground wire 12 in the ground lug 10. In a preferred embodiment, the collar second portion 26 has a pair of oppositely disposed projections 42 positioned intermediate the collar first and second ends 32, 34. The projections 42 engage the ground wire 12 when the machine screw 90 is torqued to further clamp the ground wire 12 in the collar 20.

The clamping plate 50 is inexpensive to manufacture. The clamping plate 50 may be cut from a sheet or coil of material and shaped in a single stamping operation. The tang 64 and the first and second shoulders 66, 72 provide sufficient engagement with the collar 20 to prevent rotation of the clamping plate 50 within the collar 20. Therefore, a ground lug in accordance with the present invention is not subject to disassembly due to vibration induced rotation. Further, a ground lug in accordance with the present invention does not require staking with a rivet to prevent such rotation.

While preferred embodiments have been shown and described, various modifications and substitutions may be made thereto without departing from the spirit and scope of the invention. Accordingly, it is to be understood that the present invention has been described by way of illustration and not limitation.

What is claimed is:

1. A ground lug for terminating a ground wire comprising:

collar means defining an axial receptacle, said collar means comprising longitudinally spaced first and second ends and a first surface comprising means defining a threaded aperture;

plate means comprising opposite first and second surfaces and first, second, and third segments, said second segment being disposed intermediate said first and third segments and having an axially extending tang and defining a first shoulder, said tang and said third segment defining a gap, said third segment having a first end portion having axially extending tabs defining a second shoulder, said third segment being receivable in said collar means receptacle wherein said first shoulder engages said collar means first end and said second shoulder engages said collar means second end and said collar means first end is received between said third segment and said tang, said first, second and third segments each defining a plane, said first and third segment planes being substantially parallel, said second segment plane being substantially orthogonal to said first and third segment planes; and screw means threadably positionable in said collar means aperture for engaging said plate means first surface, a ground wire being receivable in said receptacle between said collar means and said plate means second surface wherein said screw means clamps the ground wire between said plate means and said collar means.

2. The ground clamp of claim 1 wherein said collar means further comprises a U-shaped first portion and a V-shaped second portion.

3. The ground clamp of claim 2 wherein said plate means first segment comprises means defining an aperture.

4. The ground lug of claim 3 wherein said plate means third segment comprises first, second and third laterally extending portions, said second portion being intermediate said first and third portions, said third segment first, second and third portions each having a first surface, said second portion first surface defining a first plane, said first and third portion surfaces defining a second plane wherein said first plane is displaced from said second plane.

5. The ground lug of claim 1 wherein said collar means second portion comprises oppositely disposed projections positioned intermediate said first and second ends.

6. A ground lug for terminating a ground wire comprising:

collar means comprising a U-shaped first portion and a V-shaped second portion defining an axial opening, said collar means having longitudinally spaced first and second ends, said first portion having a first surface comprising means defining a threaded aperture;

plate means comprising opposite first and second surfaces, first, second, and third segments, said first segment comprising means defining an aperture, said second segment being disposed intermediate said first and third segments and defining a first shoulder, said third segment having a first end portion defining axially extending tabs defining a second shoulder, said third segment being receivable in said collar means opening wherein said first shoulder engages said collar means first end and said second shoulder engages said collar means second end, said first, second and third segments each defining a plane, said first and third segment planes being substantially parallel, said second segment plane being substantially orthogonal to said first and third segment planes; and screw means threadably positionable in said collar means opening for engaging said plate means first surface, a ground wire being receivable in said opening intermediate said second surface of said plate means and said second portion of said collar means wherein said screw means clamps the ground wire between said plate means and said collar means.

7. The ground lug of claim 6 wherein said plate means third segment comprises first, second and third laterally extending portions, said second portion being intermediate said first and third portions, said third segment first, second and third portions each defining a first surface, said second portion first surface defining a first plane, said first and third portion surfaces defining a second plane wherein said first plane is displaced from said second plane.

8. The ground lug of claim 7 wherein said collar means second portion comprises oppositely disposed projections positioned intermediate said first and second ends.

9. A ground assembly comprising:

a ground wire;

collar means comprising a U-shaped first portion and a V-shaped second portion defining an axial opening, said collar means having longitudinally spaced first and second ends, said first portion having a first surface comprising means defining a threaded aperture;

plate means comprising opposite first and second surfaces, first, second, and third segments, said first segment comprising means defining an aperture, said second segment being disposed intermediate said first and third segments and having an anti-rotation element and defining a first shoulder, said anti-rotation element and said third segment defining a gap, said third segment having a first end portion defining axially extending tabs defining a second shoulder, said third segment being receivable in said collar means opening wherein said first shoulder engages said collar means first end and said second shoulder engages said collar means second end and said collar means first end is received in said gap between said third segment and said anti-rotation device; and screw means threadably positionable in said collar means opening for engaging said plate means first surface, said ground wire being receivable in said opening intermediate said second surface of said plate means and said second portion of said collar means wherein said screw means clamps the ground wire between said plate means and said collar means.

10. The ground assembly of claim 9 wherein said plate means third segment comprises first, second and third laterally extending portions, said second portion being intermediate said first and third portions, said third segment first, second and third portions each defining a first surface, said second portion first surface defining a first plane, said first and third portion surfaces defining a second plane wherein said first plane is displaced from said second plane.

11. The ground lug of claim 10 wherein said collar means second portion comprises oppositely disposed projections positioned intermediate said first and second ends.

12. The ground lug of claim 9 wherein said first, second and third segments each define a plane, said first and third segment planes being substantially parallel, said second segment plane being substantially orthogonal to said first and third segment planes.

13. The ground lug of claim 9 wherein said anti-rotation device comprises an axially extending tang.

* * * * *